US008875600B1

(12) United States Patent
Ely

(10) Patent No.: US 8,875,600 B1
(45) Date of Patent: Nov. 4, 2014

(54) SPIRAL LIGHT BULB CHANGING DEVICE

(76) Inventor: Paul M. Ely, Buchanan, MI (US)

( * ) Notice: Subject to any disclaimer, the term of this patent is extended or adjusted under 35 U.S.C. 154(b) by 287 days.

(21) Appl. No.: 13/564,248

(22) Filed: Aug. 1, 2012

(51) Int. Cl.
*H01K 3/32* (2006.01)

(52) U.S. Cl.
USPC ..... 81/53.11

(58) Field of Classification Search
USPC ..... 81/53.1, 53.11, 53.12
See application file for complete search history.

(56) References Cited

U.S. PATENT DOCUMENTS

| | | | | |
|---|---|---|---|---|
| 2,681,822 | A * | 6/1954 | Daniels | 81/53.11 |
| 2,766,060 | A | 10/1956 | Fuller | |
| 4,852,925 | A | 8/1989 | Lodin | |
| 5,044,058 | A | 9/1991 | Voss | |
| 5,317,939 | A | 6/1994 | Marinescu | |
| 5,371,658 | A * | 12/1994 | Christie | 362/109 |
| 5,730,033 | A | 3/1998 | Mitrowski | |
| 5,806,903 | A * | 9/1998 | George | 81/53.11 |
| 5,809,580 | A | 9/1998 | Arnette | |
| 5,809,850 | A | 9/1998 | Tickner | |
| D407,282 | S | 3/1999 | MacNeil | |
| 6,223,628 | B1 | 5/2001 | Barron | |
| 6,257,095 | B1 | 7/2001 | Yukness | |
| D490,670 | S | 6/2004 | Ball et al. | |
| 6,976,407 | B1 | 12/2005 | Desaulniers | |
| 6,983,675 | B2 | 1/2006 | Scearce | |
| 8,646,362 | B2 * | 2/2014 | Schildmeier | 81/53.11 |
| 2004/0025641 | A1 | 2/2004 | Sugano | |
| 2005/0034564 | A1 | 2/2005 | Albrecht | |
| 2005/0145077 | A1 | 7/2005 | Williams | |
| 2006/0107795 | A1 | 5/2006 | Wright | |

* cited by examiner

*Primary Examiner* — Hadi Shakeri

(57) ABSTRACT

A spiral light bulb changing device includes an elongated member that has a handle connection portion and a bulb engagement portion. The bulb engagement portion has a pair of extension sections forming a slot adapted for receiving a spiral light bulb. Each of the extension sections has an upper surface. The upper surface of each of the extension sections has a plurality of wells therein. The wells are aligned with each other along a line traversing and orientated perpendicular to the slot. A pair of spacing prongs is provided. Each of the spacing prongs is removably positioned in one of the wells such that the slot is positioned between the spacing prongs. The spacing prongs each have a length such that the spacing prongs are adapted to abut a base of the light bulb when the slot receives the straight distal section of the spiral light bulb.

6 Claims, 3 Drawing Sheets

SPIRAL LIGHT BULB CHANGING DEVICE

BACKGROUND OF THE DISCLOSURE

Field of the Disclosure

The disclosure relates to light bulb changers and more particularly pertains to a new light bulb changer for engaging a spiral style light bulb to permit rotational force to be applied to the light bulb to facilitate removal and installation of a spiral style light bulb.

SUMMARY OF THE DISCLOSURE

An embodiment of the disclosure meets the needs presented above by generally comprising an elongated member that has a handle connection portion and a bulb engagement portion. The bulb engagement portion has a pair of extension sections forming a slot adapted for receiving a straight distal section of a spiral light bulb such that rotating the elongated member when the slot receives the straight distal section rotates the light bulb. Each of the extension sections has an upper surface. The upper surface of each of the extension sections has a plurality of wells therein. The wells are aligned with each other along a line traversing and orientated perpendicular to the slot. A pair of spacing prongs is provided. Each of the spacing prongs is removably positioned in one of the wells such that the slot is positioned between the spacing prongs. The spacing prongs each have a length such that the spacing prongs are adapted to abut a base of the light bulb when the slot receives the straight distal section of the spiral light bulb.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
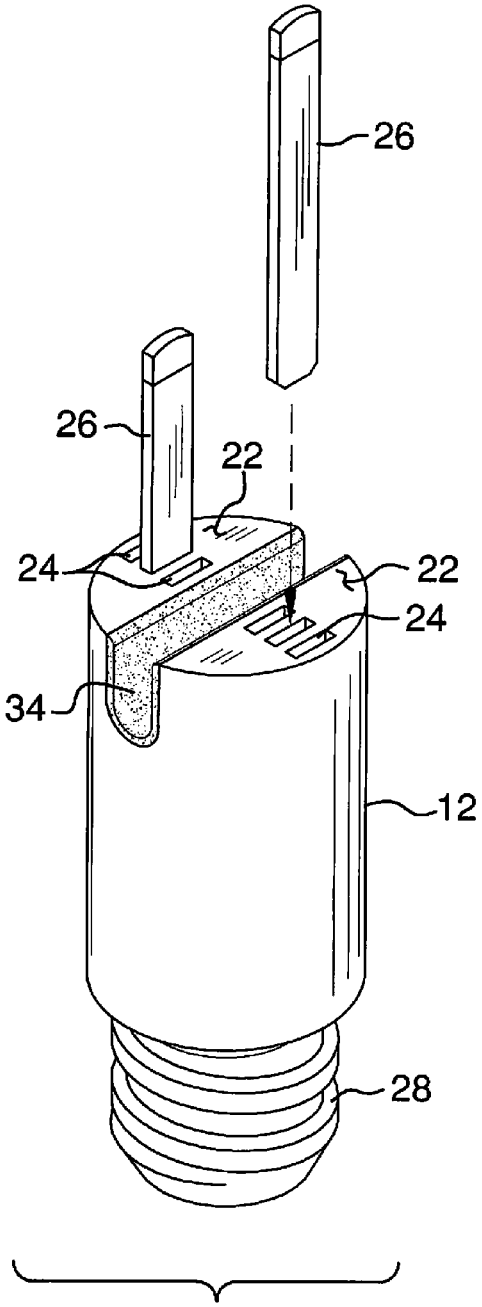
FIG. 1 is a perspective view of a spiral light bulb changing device according to an embodiment of the disclosure.
Figure 2:
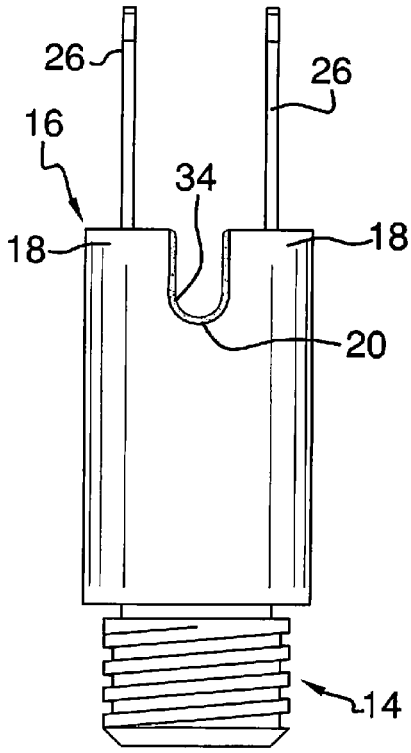
FIG. 2 is a side view of an embodiment of the disclosure.
Figure 3:
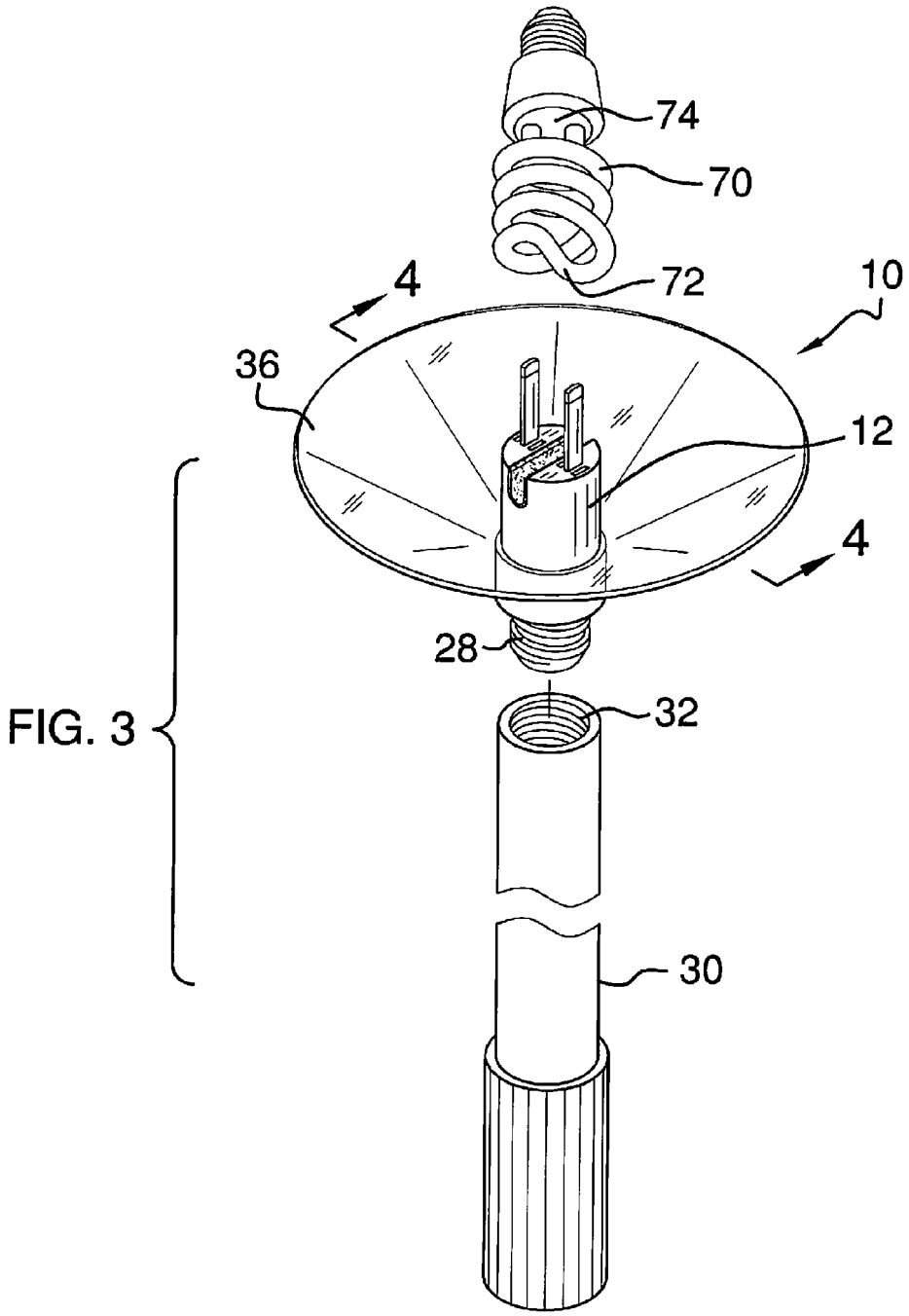
FIG. 3 is an exploded perspective view of an embodiment of the disclosure.
Figure 4:
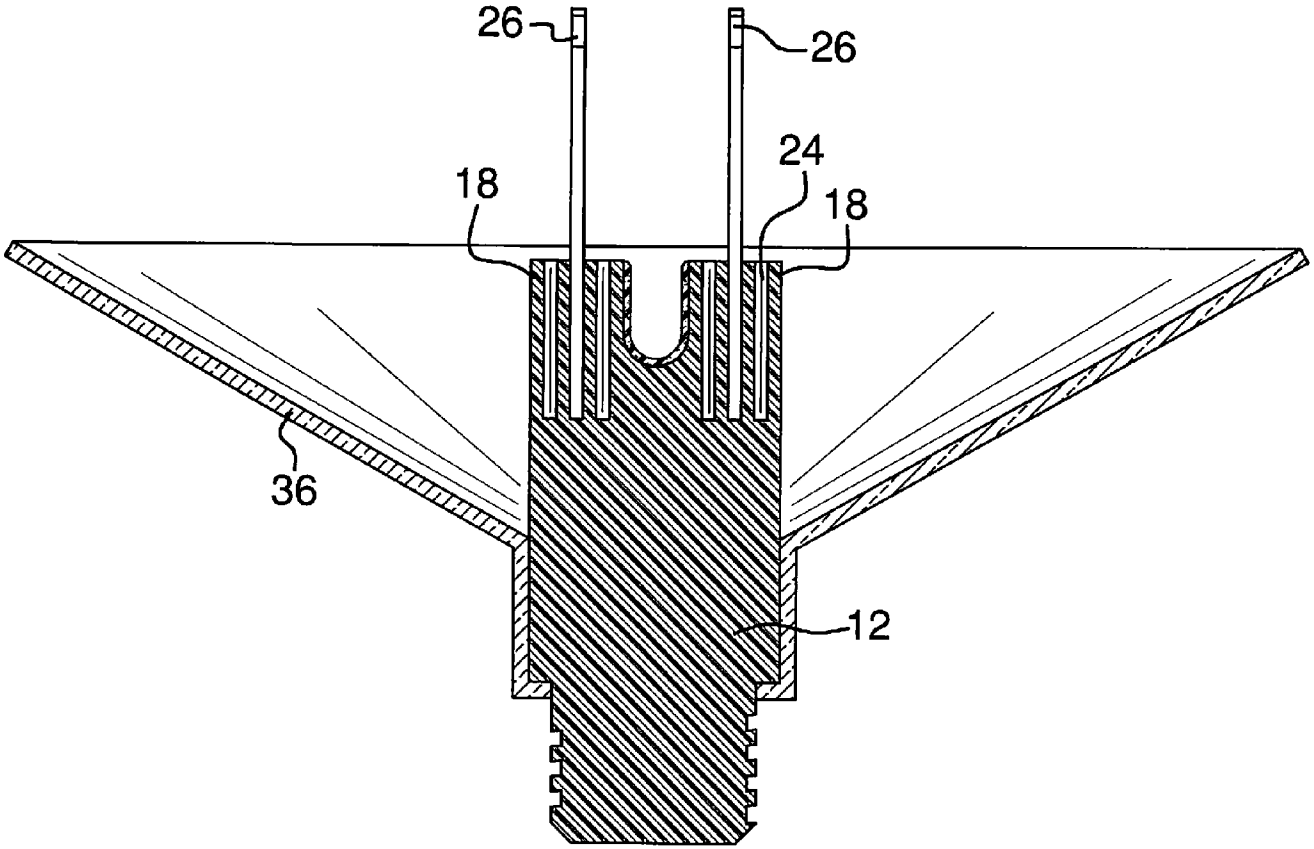
FIG. 4 is a cross-sectional side view taken along line 4-4 of FIG. 3 of an embodiment of the disclosure.

With reference now to the drawings, and in particular to FIGS. 1 through 4 thereof, a new light bulb changer embodying the principles and concepts of an embodiment of the disclosure and generally designated by the reference numeral 10 will be described.

As best illustrated in FIGS. 1 through 4, the spiral light bulb changing device 10 includes an elongated member 12 that has a handle connection portion 14 and a bulb engagement portion 16. The bulb engagement portion 16 has a pair of extension sections 18 forming a slot 20 adapted for receiving a straight distal section 72 of a spiral light bulb 70 such that rotating the elongated member 12 when the slot 20 receives the straight distal section 72 rotates the light bulb 70. The light bulb 70 is a conventional spiral type fluorescent light emitter.

Each of the extension sections 18 has an upper surface 22 and the upper surface 22 of each of the extension sections 18 has a plurality of wells 24 therein. The wells 24 are aligned with each other along a line traversing and orientated perpendicular to the slot 20. The wells 24 may be elongated along lines orientated parallel to the slot 20 and there may be at least three wells in each upper surface 22.

A pair of spacing prongs 26 is provided. Each of the spacing prongs 26 is removably positioned in one of the wells 24 such that the slot 20 is positioned between the spacing prongs 26. By being removably coupled to the elongated member 12, the spacing prongs 26 can be positioned as needed depending on the size of the light bulb 70. Each of the spacing prongs 26 has a length such that the spacing prongs 26 are adapted to abut the base 74 of the light bulb 70 when the slot 20 receives the straight distal section 72 of the spiral light bulb 70.

The handle connection portion 14 may include a threaded mating member 28. An extension pole 30 has a threaded end 32 to threadably engage the threaded mating member 28. The extension pole 30 may comprise any conventional extension type pole.

The slot 20 has an arcuate bottom edge and a cushioning material 34 is positioned on a surface of and covers the slot 20. The cushioning material 34 may include a resiliently compressible material to prevent the breaking of the light bulb 70.

A funnel 36 may be mounted on and extended around the elongated member 12. The funnel 36 extends upwardly and outwardly from the handle connection portion 28. The funnel 36 is positioned and shaped such that it will catch any glass should a light bulb 70 be broken during its removal or insertion into a light socket.

In use, the spacing prongs 70 are positioned where desired and the elongated member 12 attached to the extension pole 30. The engagement portion 16 is extended into the light bulb 70 such that the slot 20 receives the central element 72. The spacing prongs 26 will abut the light bulb 70 and stabilize it with respect to the slot 20. The pole 30 is then rotated to either insert or remove the light bulb 70 from a light socket.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A spiral light bulb changing device comprising:

an elongated member having a handle connection portion and a bulb engagement portion, said bulb engagement portion having a pair of extension sections forming a slot adapted for receiving a straight distal section of a spiral light bulb such that rotating said elongated member when said slot receives the straight distal section rotates the light bulb;

each of said extension sections having an upper surface, said upper surface of each of said extension sections having a plurality of wells therein, said wells being aligned with each other along a line traversing and orientated perpendicular to said slot; and a pair of spacing prongs, each of said spacing prongs being removably positioned in one of said wells such that said slot is positioned between said spacing prongs, said spacing prongs each having a length such that said spacing prongs are adapted to abut a base of the light bulb when said slot receives the straight distal section of the spiral light bulb; and a cushioning material being positioned on a surface of and covering said slot.

2. The spiral light bulb changing device according to claim 1, further including:

wherein said handle connection portion includes a threaded mating member; and an extension pole having a threaded end to threadably engage said threaded mating member.

3. The spiral light bulb changing device according to claim 1, wherein said slot has an arcuate bottom edge.

4. The spiral light bulb changing device according to claim 1, further including a funnel being mounted on and extending around said elongated member, said funnel extending upwardly and outwardly from said handle connection portion.

5. The spiral light bulb changing device according to claim 1, further including a cushioning material being positioned on a surface of and covering said slot.

6. A spiral light bulb changing device comprising:

an elongated member having a handle connection portion and a bulb engagement portion, said bulb engagement portion having a pair of extension sections forming a slot adapted for receiving a straight distal section of a spiral light bulb such that rotating said elongated member when said slot receives the straight distal section rotates the light bulb;

each of said extension sections having an upper surface, said upper surface of each of said extension sections having a plurality of wells therein, said wells being aligned with each other along a line traversing and orientated perpendicular to said slot;

a pair of spacing prongs, each of said spacing prongs being removably positioned in one of said wells such that said slot is positioned between said spacing prongs, said spacing prongs each having a length such that said spacing prongs are adapted to abut a base of the light bulb when said slot receives the straight distal section of the spiral light bulb;

wherein said handle connection portion includes a threaded mating member;

an extension pole having a threaded end to threadably engage said threaded mating member;

said slot having an arcuate bottom edge;

a cushioning material being positioned on a surface of and covering said slot; and a funnel being mounted on and extending around said elongated member, said funnel extending upwardly and outwardly from said handle connection portion.

* * * * *